US006416453B1

(12) United States Patent
Simonetti et al.

(10) Patent No.: US 6,416,453 B1
(45) Date of Patent: Jul. 9, 2002

(54) SEAL BAR MECHANISM FOR BAG MACHINES

(75) Inventors: John Simonetti, Deer Park; Peter Terranova, Howard Beach, both of NY (US)

(73) Assignee: Ro-An Industries Corp., Maspeth, NY (US)

( * ) Notice: Subject to any disclaimer, the term of this patent is extended or adjusted under 35 U.S.C. 154(b) by 0 days.

(21) Appl. No.: 09/547,572

(22) Filed: Apr. 12, 2000

Related U.S. Application Data

(60) Provisional application No. 60/128,897, filed on Apr. 12, 1999.

(51) Int. Cl.[7] ..... B31C 1/00; B31B 1/64

(52) U.S. Cl. ..... 493/269; 493/22; 493/189; 493/209; 493/242

(58) Field of Search ..... 493/22, 29, 189, 493/193, 199, 196, 209, 242

(56) References Cited

U.S. PATENT DOCUMENTS 5,041,070 A * 8/1991 Blaser ..... 493/14
5,094,656 A * 3/1992 Hatchell et al. ..... 493/193

FOREIGN PATENT DOCUMENTS

| | | | | |
|---|---|---|---|---|
| EP | 0999141 | * | 5/2000 | ..... B65B/61/06 |
| GB | 2297074 | * | 7/1996 | ..... B65B/57/10 |

* cited by examiner

*Primary Examiner*—John Sipos
*Assistant Examiner*—Hemant M. Desai
(74) *Attorney, Agent, or Firm*—Steinberg & Raskin, P.C.

(57) ABSTRACT

The present invention relates to a "poly" bag machine and, more particularly, to mechanisms for operating the seal bar component of such machines. The machine according to the invention includes a mechanism for reciprocatingly raising and lowering the sealing bar in which the movement and position of the sealing bar are controlled by the drive shaft and are selectively adjustable by one or two separate servo-drives. A main link is coupled to a seal bar drive shaft for movement in direct response to its rotation. A second link is movably coupled to the main link. A servo-drive system including a servo motor or servo valve is coupled to the second link for adjusting the position of the second link with respect to the main link while the main link is moving in response to the rotation of the drive shaft.

8 Claims, 7 Drawing Sheets

SEAL BAR MECHANISM FOR BAG MACHINES

This application claims benefit to U.S. provisional application serial No. 60/128,897, filed Apr. 12, 1999.

BACKGROUND OF THE INVENTION

This invention relates generally to "poly" bag making machines and, more particularly, to mechanisms for operating the seal bar component of such bag making machines.

Poly bag making machines are well known. Draw rolls pull a web of plastic film material from a supply. A transverse cutting and sealing bar (hereinafter referred to as a seal bar), is situated after the draw rolls and mounted for reciprocation to cut and seal the web after each web index movement to form individual bags. The bags are carried to a stacking station on a stacker conveyer by means of a rotating vacuum arm assembly. Bag machines of the type described are well known. For example, a typical bag making machine of this type is The Polystar 9000 available from Ro-An Industries Corp. of Maspeth, N.Y., U.S.A.

Generally, bag making machines of the type described are powered by a main drive motor that drives a main drive shaft which in turn drives the various components of the bag making machine, including the draw rolls, seal bar, vacuum arm assembly and stacker conveyer, through conventional mechanical linkages including, gears, pulleys, crank and rocker arms, clutch/brake systems, cams and cam followers and the like.

Recently, servo drives have been used to drive various components of bag making machines. For example, servo motors are used to drive the draw rolls and stacker conveyer components of bag making machines in a coordinated manner through a servo-controller in order to reduce the number of cycle interrupts required within which to index the stacker conveyer when a stacker station has been filled with bags. In this connection, reference is made to U.S. Pat. No. 5,338,281 to Terranova, the disclosure of which is incorporated herein in its entirety.

It has also been proposed to replace the conventional cam and cam follower mechanism for reciprocating the seal bar by a servo motor or servo valve to drive a linkage to raise and lower the seal bar of the bag making machine so that the position, and motion of the seal bar, including its dwell time in the fully down and sealing position, can be controlled independently of the machine speed and other components of the bag machine. In this connection, reference is made to U.S. Pat. No. 5,230,688, to Hatchell, et al., the disclosure of which is incorporated herein in its entirety.

However, reciprocatingly driving a seal bar by a servo motor or servo valve requires substantial modification of relevant components of the bag making machine. Moreover, any benefits obtained by the substantial modifications required to provide an independent operation of the seal bar are often outweighed by the substantial expense of the modifications which are required to accomplish this end.

Moreover, prior arrangements for reciprocating the seal bar in bag making machines are designed to raise and lower the seal bar in a uniform manner, i.e. so that the seal bar is lowered onto and contacts the plastic web uniformly over the entire width at the same time with a constant degree of penetration. While such operation is generally suitable, there are some applications,, e.g. in the sealing of certain multiple ply plastic webs, where it would be desirable to first lower one end of the seal bar onto the web and then gradually lower the other end so that the seal bar engages the web progressively from one edge of the web to the other. Other applications make it desirable to have different degrees of penetration of the web by the seal bar at respective end regions of the seal bar. However, it is not possible to accomplish these functions using conventional mechanical and servo controlled mechanisms for raising and lowering the seal bar.

SUMMARY OF THE INVENTION

Accordingly, it is an object of the present invention to provide new and improved mechanisms for driving a seal bar in a bag machine.

Another object of the present invention is to provide new and improved mechanisms for adjusting the position and movement of a seal bar in a bag making machine which is controlled by the machine's drive shaft.

Still another object of the present invention is to provide new and improved mechanisms for adjusting the position and movement of a seal bar in a bag making machine which is controlled by the machine's drive shaft and which enables a selective adjustment of the dwell time of the seal bar.

Yet still another object of the present invention is to provide new and improved mechanisms for adjusting the position and movement of a seal bar in a bag making machine in which the raising and lowering of each respective end of the seal bar is independently adjustable.

Briefly, in accordance with the present invention, these and other objects are attained by providing an improvement in the mechanism for reciprocatingly raising and lowering the sealing bar in which the movement and position of the sealing bar are controlled by the drive shaft and are selectively adjustable by one or two separate servo-drives.

A main link is coupled to a seal bar drive shaft for movement in direct response to its rotation. A second link is movably coupled to the main link. A servo-drive system including a servo motor or servo valve is coupled to the second link for adjusting the position of the second link with respect to the main link while the main link is moving in response to the rotation of the drive shaft.

Separate mechanisms may be provided for controlling and adjusting the position and movement of each one of the two ends of the sealing bar, independently of each other, in a coordinated fashion. Independent adjustment allows for variations of the sealing profile and seal bar penetration.

DETAILED DESCRIPTION OF THE DRAWINGS

A more complete appreciation of the present invention and many of the attendant advantages thereof will be obtained by reference to the following detailed description when considered in connection with the accompanying drawings in which.

DETAILED DESCRIPTION OF THE PREFERRED EMBODIMENTS

Figure 1:
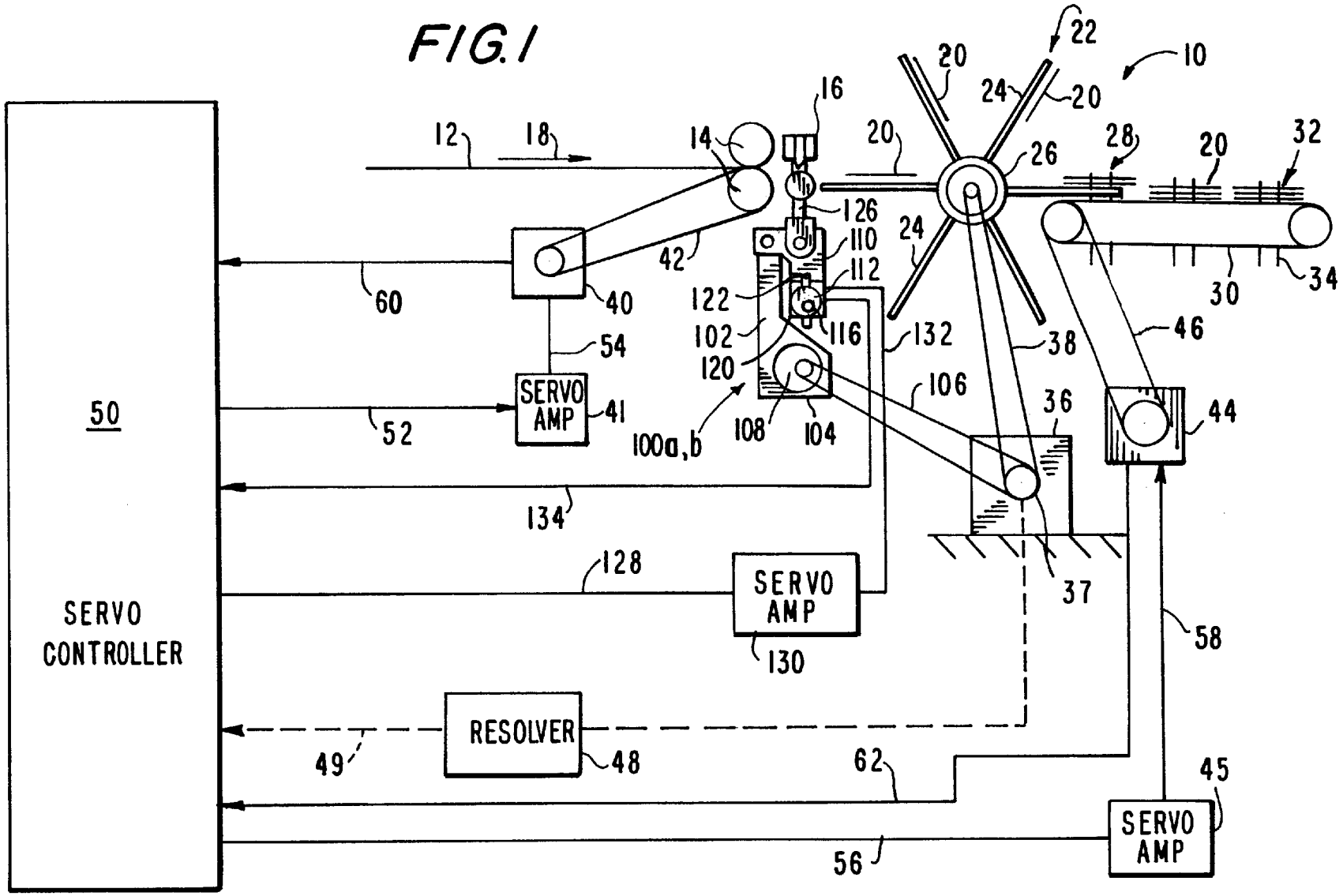
FIG. 1 is a diagrammatic representation of a bag making machine incorporating a first embodiment of a seal bar mechanism in accordance with the present invention, including a block diagram of a servo control system for the machine.

Referring now to the drawings wherein like reference characters designate identical or corresponding parts throughout the several views, and more particularly to FIG. 1, a bag machine 10 for making "poly" bags from a web 12 of plastic material is shown. The web 12 is drawn from a supply roll (not shown) by a pair of draw rolls 14. A seal bar 16 extends over the web 12 in the direction transverse to the running direction 18 of the machine and is mounted for reciprocation to cut and seal the web 12 after each web index movement to form individual bags 20. A rotating vacuum arm assembly or wicketer 22 is arranged after the seal bar 16 in the running direction of the machine. The wickeder 22 has a plurality of pairs of arms 24 extending radially from a hub 26. Each pair of arms 24 picks up a bag 20 that has been formed by seal bar 16 and carries it onto a stack of bags 20 being formed at a stacking station 28 of a stacking conveyer 30. A plurality of stacking stands 32 comprising sets of wicket pins 34 are mounted on conveyer 30 for intermittent movement into the stacking station 28 to be filled with bags 20 by the vacuum arm assembly 22.

The main drive shaft 37 of drive motor 36 drives the vacuum arm assembly 22 by belt or chain 38 and also drives the seal bar 16 in a manner according to the present invention as described below.

The draw rolls 14 are driven by a servo-motor 40 having a servo-amplifier 41 through a belt or chain 42. The stacking conveyer 30 is driven by a servo-motor 44 having a servo amplifier 45 through a belt or chain 46. An encoder or resolver 48 is coupled to the main drive shaft 37 and provides a zero marker signal 49 indicative of the position and movement of the main drive shaft. The resolver 48 directs the signal 49 to an encoder interface in the servo-controller 50 which also includes timing modules, command signal generators and profile generators for operating various components of the bag machine 10.

In accordance with one mode of operation, the controller 50 through resolver 48 counts the number of bags 20 formed by seal bar 16 and when a predetermined number corresponding to a completed stack have been formed, a signal 52 is directed to servo-amplifier 41 which sends a signal 4 to servo-motor 40 to interrupt the operation of draw rolls 14 for a minimum number of interrupt cycles corresponding to a minimum number of wicket arm pairs which will thus be empty to provide sufficient time for the stacking conveyer 30 to index an empty stacking stand 32 into the stacking station 28. After an interval of time sufficient to allow the last bag 20 formed prior to cycle interrupt to be carried to stacking station 28, controller 50 sends a signal 56 to servo amplifier 45 which in turns sends a signal 58 to energize servo motor 44 to index the stacking conveyer 30 and move an empty stacking stand 32 into stacking station 28. Each servo motor 40, 44 feeds back a respective encoder signal 60, 62 indicative of its position and movement to the servo-controller 50.

The present invention concerns the mechanism for mounting the seal bar 16 to the bag machine 10 for reciprocatingly raising the seal bar 16 to allow the plastic web 12 to be drawn a pre-determined distance and then lowering the seal bar onto the stationary web to seal and cut the web into individual bags 20. Referring to FIGS. 1–5, a first embodiment of a seal bar mechanism, designated 100, is illustrated which comprises a pair of substantially identical mechanisms 100*a*, 100*b* for controlling and adjusting the position and movement of respective ends 16*a*, 16*b* of the seal bar 16.

Each seal bar mechanism 100*a*, 100*b* comprises a main link 102 coupled to the drive shaft 104 for movement in response to the rotation of drive shaft 104. The drive shaft 104 is mounted on the frame of bag machine 10 with a fixed axis of rotation and is powered by the main drive shaft 37 through a belt or chain 106 (FIG. 1.). In the illustrated embodiment, each main link 102 has an elongated lever portion 102*a* and is coupled to drive shaft 104 by means of an eccentric member 108 fitted into an enlarged body portion 102*b* of main link 102 at the lower end of lever portion 102*a*. Each mechanism 100*a*, 100*b* includes a second L-shaped link 110 comprising a first leg 110*a* and a second leg 100*b*. The free end of first leg 110*a* of second link 110 is pivotally connected to the upper free end of the lever portion 102*a* of main link 102.

Each mechanism 100*a*, 100*b* includes a respective servo-drive in the form of a respective servo-motor 112 mounted on the machine frame 114. The servo motor 112 includes a servo-drive shaft 116 having a fixed axis which drives an eccentric member 118 mounted in a follower member 120. The follower member 120 in turn is fixed to a rail member 122 which is slidably received in a linear bearing 124 fixed to the second leg 110*b* of second link 110. Each mechanism 100*a*, 100*b* includes a respective connecting link 126 which is connected at one end to a respective end 16*a*, 16*b* of seal bar 16 and at its other end pivotally to the second link 110 at the intersection of its first and second legs 110*a*, 110*b*.

Figure 2:
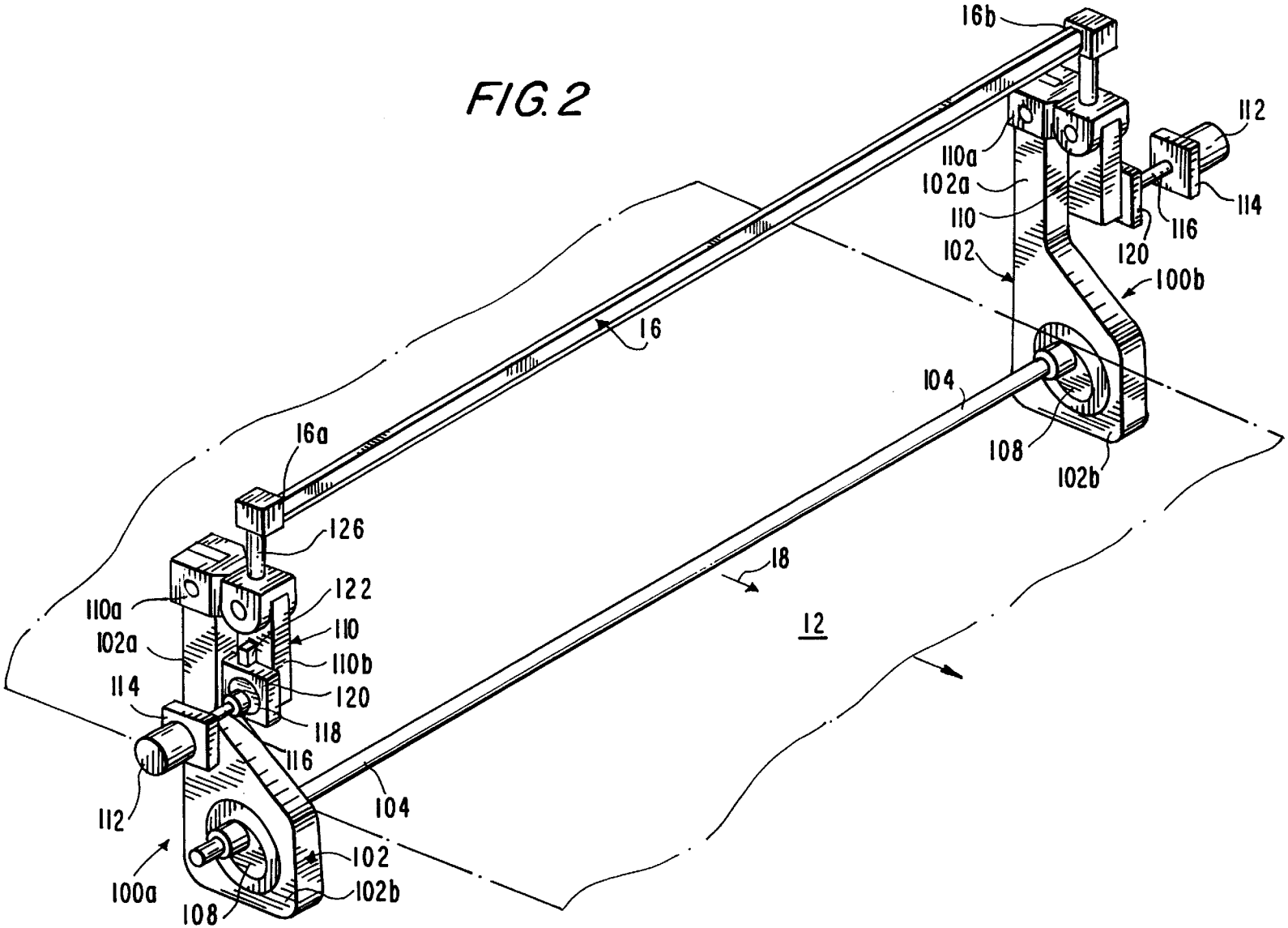
FIG. 2 is a perspective view of a seal bar and a seal bar mechanism in accordance with the first embodiment.

As best seen in FIG. 2, separate but substantantially identical mechanisms 100*a*, 100*b* having separate respective servo-motors 112, are used to raise and lower the respective ends 16*a*, 16*b* of seal bar 16. As discussed below, while both mechanisms are driven and controlled by the rotation of the drive shaft 104 powered by main drive shaft 37, the position and movement of each seal bar end can be independently adjusted utilizing the respective servo-motor 112 of the respective mechanism 100*a*, 100*b*.

Figure 3:
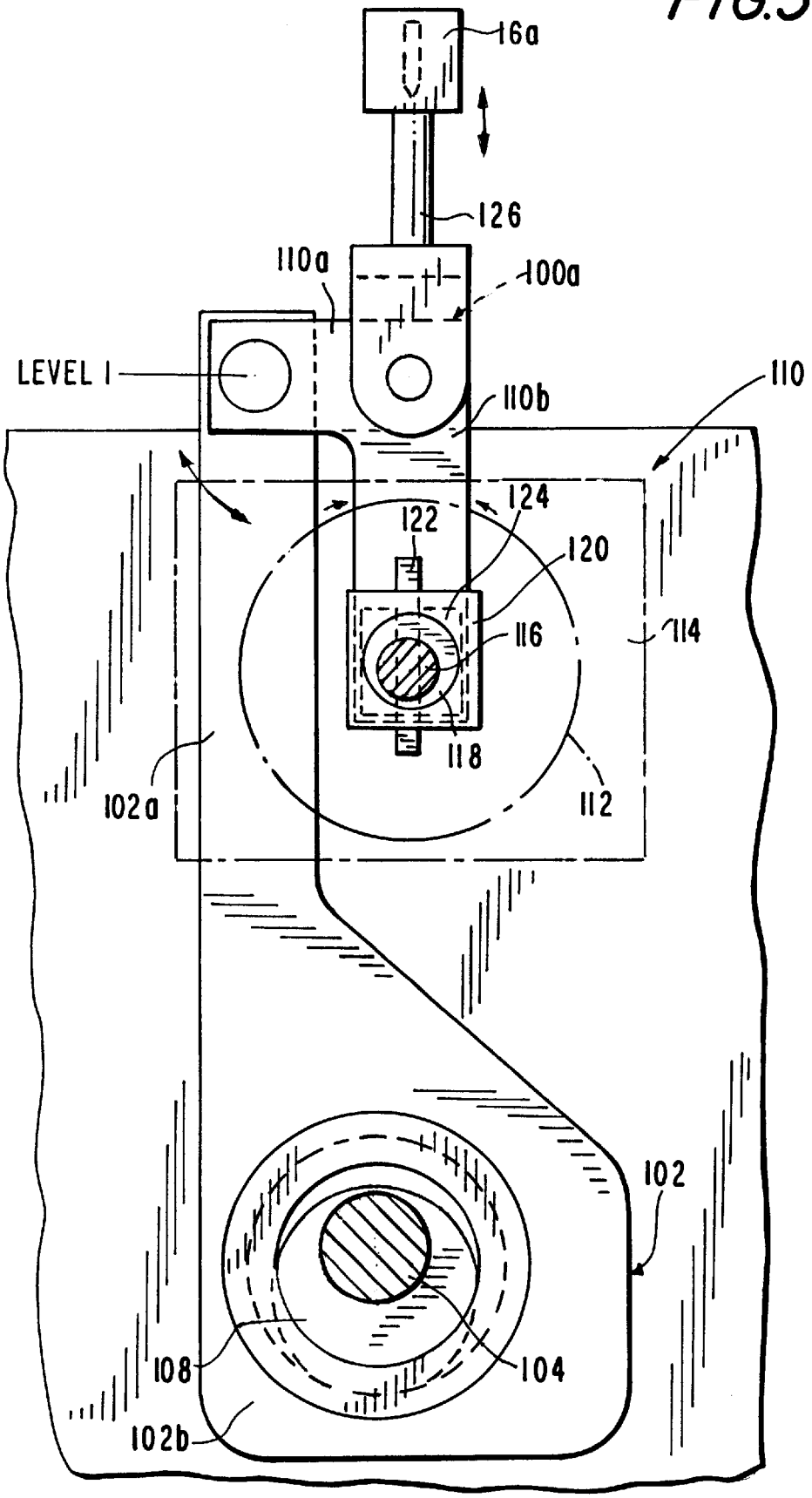
FIG. 3 is a diagrammatic front view of a seal bar mechanism in accordance with the first embodiment.

The operation of mechanism 100*a* to adjust the dwell time of seal bar 16 will now be described. The end 16*a* of the seal bar 16 is in its bottom or dwell position is shown in FIG. 3. Rotation of the drive shaft 104 from the position shown in FIG. 3 to the position shown in FIG. 4 results in the elevation of the pivot at the free end of lever portion 102*a* of main link 102 by means of the eccentric member 108, from a level designated "1" in FIG. 3 to a level designated "2" in FIG. 4. In conventional designs in which the seal bar is connected to the main link 102, the elevation of the main link caused by the rotation of drive shaft 104 results in a comparable elevation of the seal bar 16. However, by means of the present invention, the position and movement of the seal bar 16 can be adjusted, for example, to maintain the seal bar in the dwell position for a selected period.

Figure 4:
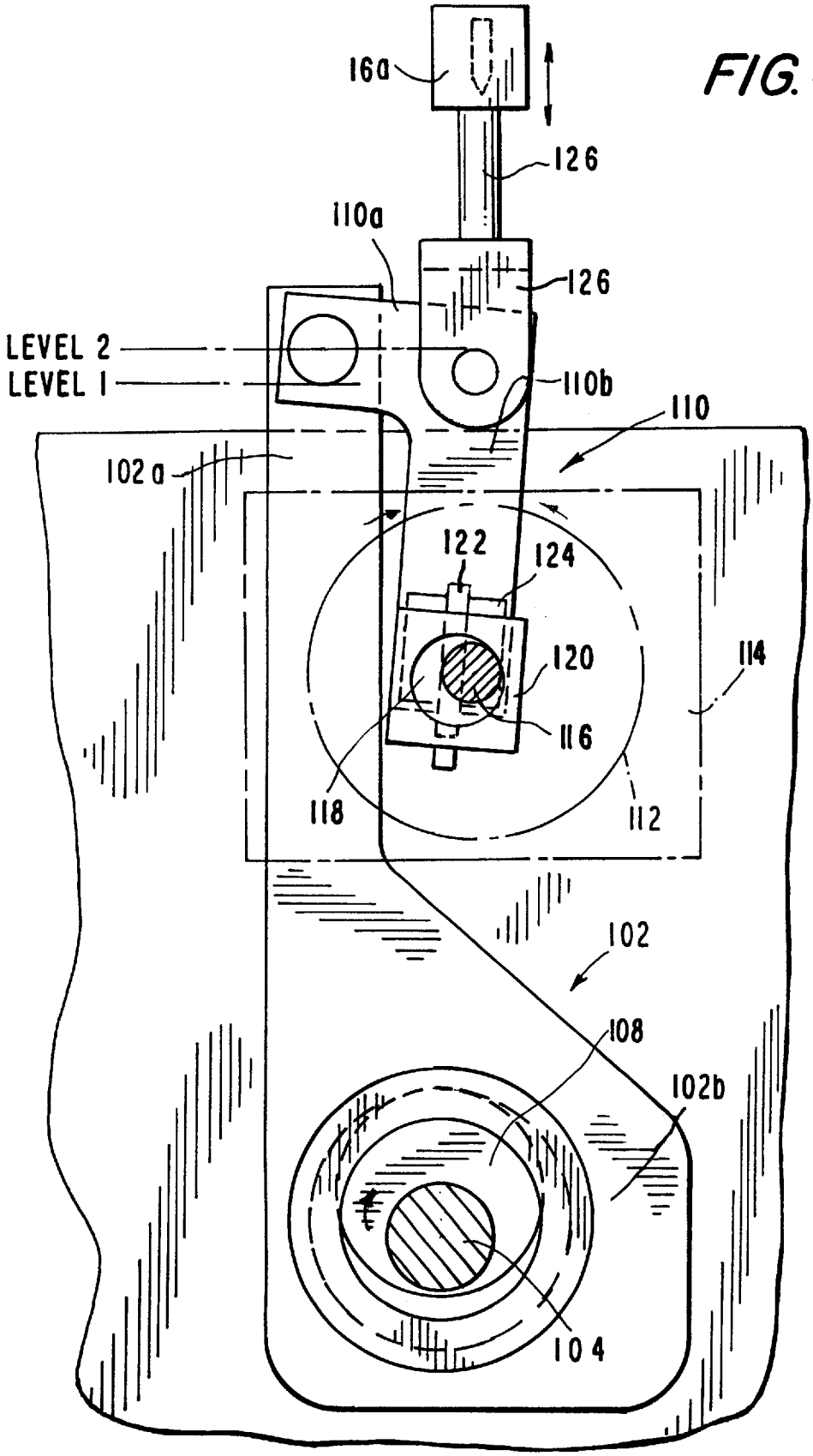
FIG. 4 is a view similar to FIG. 3 showing the first embodiment of the seal bar mechanism at a subsequent stage of operation.
Figure 5:
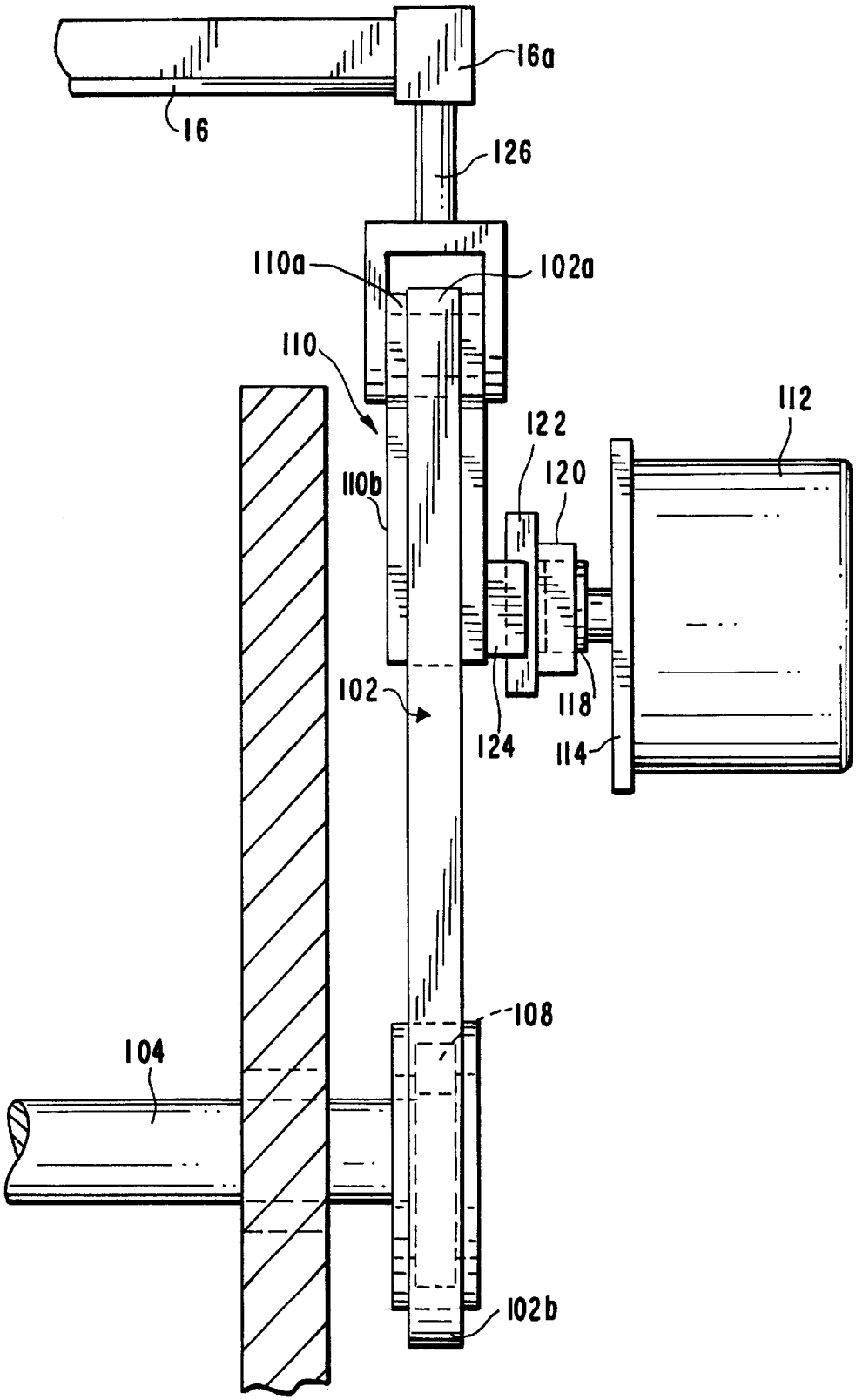
FIG. 5 is a diagrammatic side view of a seal bar mechanism in accordance with the first embodiment.

As the drive shaft 104 rotates and the main link 102 is raised from the position illustrated in FIG. 3 to the position illustrated in FIG. 4, the servo-motor 112 is energized to rotate the servo drive shaft 116 to turn the eccentric member 118 and thereby rotate the follower member 120 as best seen in FIG. 4. The rotation of the follower member 120 is accommodated by a linear sliding movement of the follower member 120 on the second leg 110*b* of second link 110 enabled by the rail and linear bearing arrangement. Rotation of follower member 120 adjusts the position of the second link by rotating counter-clockwise in FIG. 4 thereby causing the point on second link 110 at which the seal bar connecting link 126 is connected to remain essentially at the same level as that shown in FIG. 3, i.e., level "1", despite the continued rotation of the drive shaft 104. It will therefore be seen that the invention enables the drive shaft to control the position and operation of the seal bar while its position and movement can be adjusted by means of the servo-controlled mechanism.

Referring to FIG. 1, as discussed above, the position and movement of the main drive shaft 37 is input to servo-controller 50 by resolver 48. This information also provides the position of the main link 102 of seal bar mechanism 100. The desired profile for the reciprocation of seal bar 16 including a desired dwell time is input by an operator into and resides in a profile generator in servo-controller 50. The positions of the second link 110 relative to the main link 102 which will result in the desired adjustments in the position and movement of the ends of the seal bar to obtain the desired profile are calculated and signals 128 are directed to servo amplifier 130 to send energize signals 132 to servo motor 112 to rotate second link 110. Encoder feedback signals 134 are looped back to servo controller 50 to obtain the desired movement profile for seal bar 16.

As explained above, a separate seal bar mechanism 100*a*, 100*b* is provided at each end 16*a*, 16*b* of seal bar 16. When it is desired that the seal bar be raised and lowered in a uniform manner, i.e., so that the seal bar is lowered onto and contacts the plastic web uniformly over its entire width at the same time and with a constant degree of penetration, the identical desired profile will be set for the servo-drive of each of the two seal bar mechanisms. On the other hand, if it is desired to first lower one end of the seal bar onto the web and then gradually lower the other end so that the seal bar engages the web progressively from one edge to the other, or if it is desired to achieve different degrees of seal bar penetration at respective edge regions of the web, it is a simple matter to vary the profiles of the servo-drives of each of the two seal bar mechanisms independently of each other to achieve these objects.

Referring to FIG. 1, it will be seen that the servo-controller 50 comprises a 4-axis servo-controller for controlling the draw roll servo-motor 40, the stacker conveyer servo-motor 44, and the two seal bar servo-motors 112. A suitable servo-controller is the model MSC850 available from Industrial Indexing Systems, Inc. of Victor, N.Y.

Figure 6:
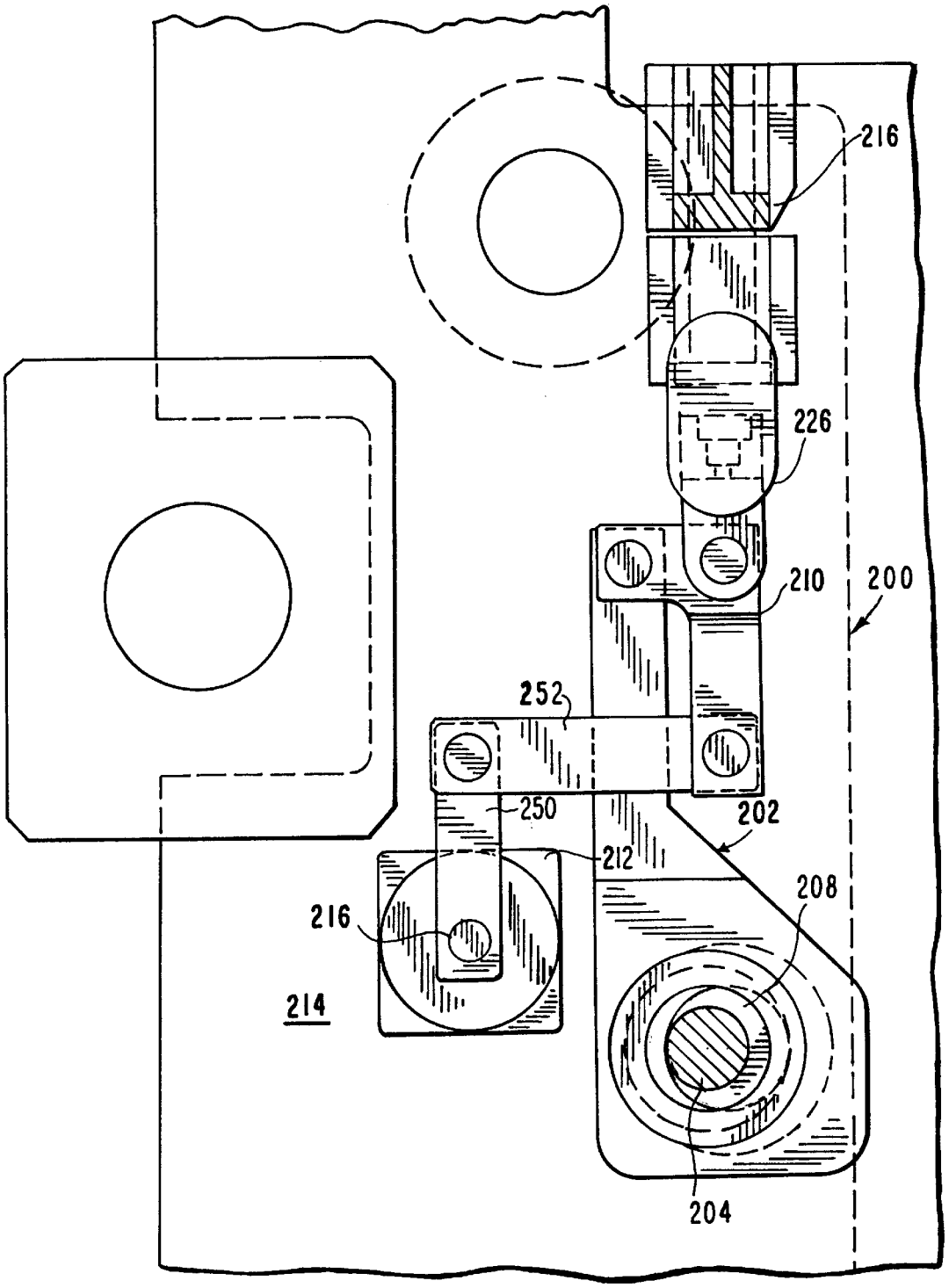
FIG. 6 is a diagrammatic front view of a seal bar mechanism in accordance with a second embodiment of the invention.

Referring to FIG. 6, another embodiment of a seal bar mechanism in accordance with the invention, designated 200, is shown. Parts of seal bar mechanism 200 are similar or identical to parts of mechanism 100 and are designated by like numbers in the "200 " series. Mechanism 200 includes a main link 202 coupled to a drive shaft 204 by an eccentric member 208. A second L-shaped link 220 is pivotally mounted to the free end of main link 202. A connecting link 226 connects the seal bar head 216 to the second link 210. A servo-motor 212 having a servo-drive shaft 216 is mounted on the bag machine frame 214. The servo-drive shaft 216 is coupled to the second link 210 by means of an articulated linkage comprising links 250 and 252 which are pivotally connected to each other and to servo-drive shaft 216 and second link 210, respectively. The servo controller is programmed to cause energizing signals to be sent to servo motor 212 to rotate shaft 216 to turn second link 210 to obtain the desired profile for the reciprocation of the seal bar to which the mechanism 200 is coupled.

Figure 7:
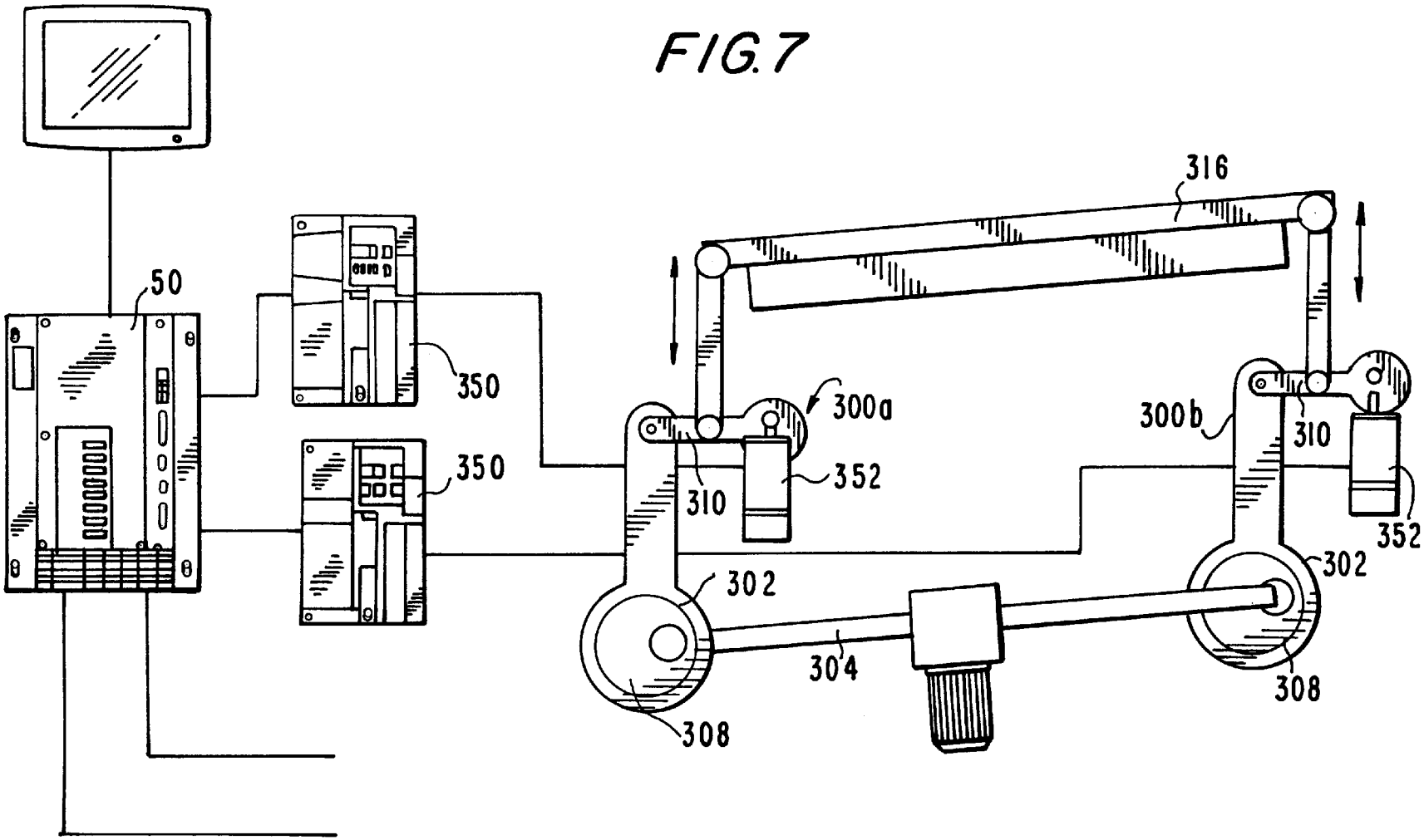
FIG. 7 is a diagrammatic representation of a third embodiment of a seal bar mechanism in accordance with the present invention and showing a block diagram of part of a servo control system for the machine.

Referring to FIG. 7, a third embodiment of a seal bar mechanism in accordance with the invention, designated 300, is shown. Parts of seal bar mechanism 300 that are similar or identical to parts of mechanism 100 are designated by like reference characters in the "300" series. Each mechanism 300 includes a main link 302 coupled to drive shaft 304 by an eccentric member, 308.

A second link 310 is pivotally mounted to the free end of main link 302. A connecting link 326 connects the seal bar head 316 to the second link 310. The servo-drive of each of the seal bar mechanisms comprises a servo-controlled valve 350 and a fluid cylinder assembly 352 coupled to the servo-controlled valve for operation thereby. The assembly 352 in turn is coupled to the second link 310 to adjust its position with respect to the main link 301. As in the case of the previously described embodiments, the profile generators in the servo-controller 50 are programmed to control the servo-valves to obtain the desired movement profiles.

Obviously, numerous modifications and variations of the present invention are possible in the light of the above teachings. It is therefore to be understood that within the scope of the claims appended hereto, the invention may be practiced otherwise than as specifically disclosed herein.

We claim:

1. In a bag making machine in which a plastic web is intermittently drawn in a longitudinal running direction of the bag machine and which includes a frame, a main drive motor driving a drive shaft mounted on said frame, a seal bar extending over the web in a direction transverse to the running direction of the machine, said seal bar having opposite ends mounted to said frame by a mechanism for reciprocatingly raising the seal bar from the plastic web to allow drawing of the web, and lowering the seal bar onto the plastic web when the web is stationary to seal and cut the plastic web to form individual bags, the improvement comprising:

said mechanism for reciprocatingly raising and lowering the seal bar includes first means for controlling and adjusting the position and movement of a first one of said two seal bar ends; and second means for controlling and adjusting the position and movement of the second one of said seal bar ends, said adjustments in said position and movement of said second one of said seal bar ends being independent of the adjustment of the position and movement of the first seal bar end.

2. The improvement of claim 1 wherein each of said first and second seal bar end controlling and adjusting means includes:

a respective main link;

a respective drive shaft coupling means coupling said main link to said drive shaft for movement in direct response to the rotation of said drive shaft;

a respective second link movably coupled to said main link;

a respective servo-drive coupled to said second link for adjusting the position of said second link with respect to said main link while said main link is moving in response to the rotation of said main shaft; and a respective connecting link coupling a respective one of said seal bar ends to said second link.

3. The improvement of claim 2 wherein said drive shaft coupling means of each of said first and second seal bar end controlling and adjusting means comprises a respective eccentric member.

4. The improvement of claim 2 wherein said second link of each of said first and second seal bar controlling and adjusting means is pivotally mounted to said main link.

5. The improvement of claim 2 wherein said respective servo-drive of each of said first and second seal bar end controlling and adjusting means comprises a servo-motor mounted on said frame, said servo-motor including a servo-drive shaft, a follower member eccentrically mounted on said servo-drive shaft, said follower member slidably coupled to said second link.

6. The improvement of claim 2 wherein said respective servo-drive of each of said first and second seal bar end controlling and adjusting means comprises a servo-motor mounted on said frame, said servo motor including a servo-drive shaft, and an articulated linkage interconnecting said servo-drive shaft to said second link.

7. The improvement of claim 2 wherein said respective servo-drive of each of said first and second seal bar end controlling and adjusting means comprises a servo-controlled valve mounted on said frame; a fluid cylinder assembly coupled to said servo controlled valve for being controlled thereby, said fluid cylinder assembly being coupled to said servo-controlled valve for being controlled thereby, said fluid cylinder assembly being coupled to said second link.

8. The improvement of claim 2 further including a servo-controller coupled to each servo-drive of said first and second seal bar end controlling and adjusting means; means for relating the absolute position of said main drive shaft to said servo-controller; said servo-controller controlling the operation of said servo-drives.

* * * * *